US005297706A

United States Patent [19]

Blitz

[11] Patent Number: 5,297,706

[45] Date of Patent: Mar. 29, 1994

[54] CLOTHES HANGER CONSTRUCTION WITH ATTACHED LOCKING DEVICE

[75] Inventor: Leslie Blitz, New Hyde Park, N.Y.

[73] Assignee: Mode Plastics, Inc., New York, N.Y.

[21] Appl. No.: 990,664

[22] Filed: Dec. 14, 1992

[51] Int. Cl.[5] ..... A47G 25/48

[52] U.S. Cl. ..... 223/96; 223/91; 223/93

[58] Field of Search ..... 24/564, 567, 489; 223/96, 91, 90, 93, 85, 88; D6/315, 326, 327

[56] References Cited

U.S. PATENT DOCUMENTS

| | | | |
|---|---|---|---|
| 2,517,336 | 8/1950 | Neal | 223/91 |
| 3,767,092 | 10/1973 | Garrison et al. | 223/96 |
| 4,157,782 | 6/1979 | Mainetti | 223/96 |
| 4,701,983 | 10/1987 | Warmath | 24/564 |
| 4,852,777 | 8/1989 | Balkin | 223/96 |
| 5,020,705 | 6/1991 | Garrison | 223/96 |
| 5,082,153 | 1/1992 | Duester et al. | 223/96 |
| 5,178,306 | 1/1993 | Petrou | 223/91 |

*Primary Examiner*—Clifford D. Crowder

*Assistant Examiner*—Bibhu Mohanty

*Attorney, Agent, or Firm*—Henry R. Lerner

[57] ABSTRACT

A clothes hanger having a transversely extending member for supporting thereon articles of clothing by means of clamps, each of which has a pair of jaws adapted to hold therebetween free edges of the garment to be supported. The jaws of the clamp are adapted to be held in confronting biased condition for retaining the article of clothing in between the jaws of the clamp. A plastic locking device is provided for maintaining the confronting jaws of the clamp in closed condition, whereby the garments are retained by said hanger. The locking device is U-shaped and comprises a pair of legs adapted to straddle the jaws and maintain them in mutually biased condition for retaining any articles of clothing held by said clamps; the locking device is provided with a base which is connected to the transversely extending member of the hanger by a small piece of webbing whereby the locking device is pivotably movable into and out of engagement with said clamping jaws, said locking device being formed as part of a one piece molding operation which includes the hanger.

9 Claims, 4 Drawing Sheets

FIG. 3
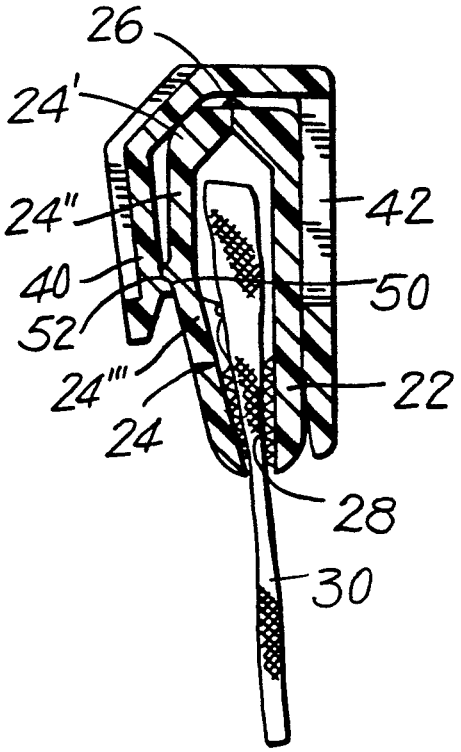
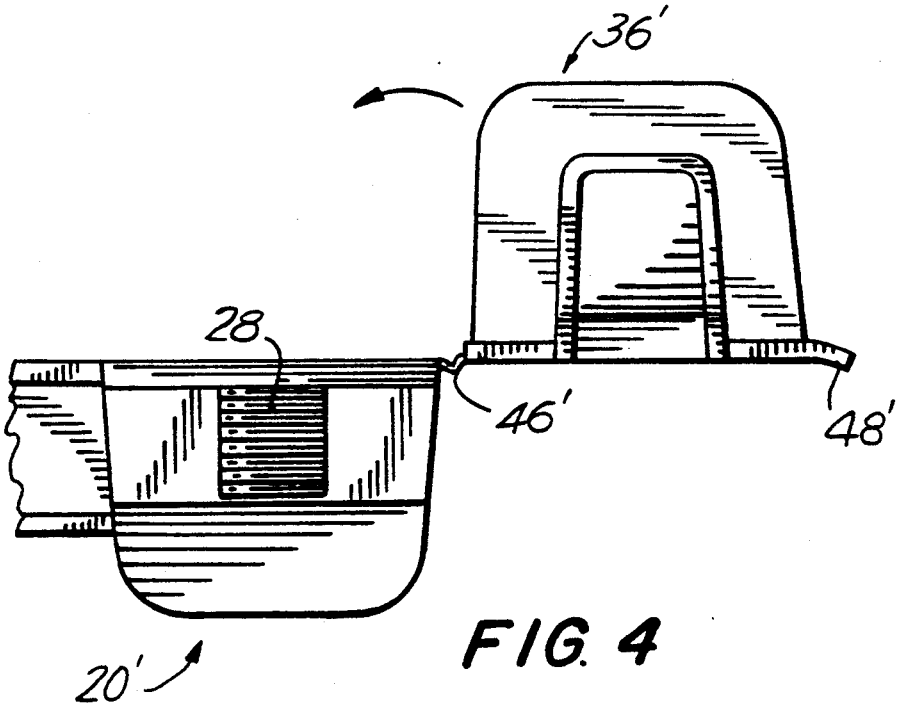
FIG. 4

CLOTHES HANGER CONSTRUCTION WITH ATTACHED LOCKING DEVICE

This application relates to a hanger of the type which is used to suspend articles of wearing apparel, such as shorter garments, as, for example, skirts, shorts and the like, which cannot usually be suspended over the transversely extending supporting member included in the conventional hanger.

BACKGROUND OF THE INVENTION

Hangers of the type involved herein usually comprise a transverse support arm which mounts a pair of spaced clamps. Each clamp includes a fixed jaw and a movable jaw, whereby a free edge of a clothing article to be supported by the hanger is inserted between the stationery and movable jaws, with the movable jaw being brought into confrontation with the stationery jaw.

In order to maintain the clamping jaws biased toward each other, with the clothing article therebetween, it is necessary to provide some kind of locking device. Such locking device is usually "U"-shaped, having a base and a pair of legs extending from opposite ends of the base. The locking device is placed over the clamp so that the legs of the locking device engage the outer sides of the clamping jaws. The legs of the locking device are normally spaced from each other a distance which is slightly less than the distance between the outer sides of the clamping jaws when biased towards each other. Accordingly, the placing of the locking device over the clamp causes the legs to flex and produce an opposite counter-force which biases the clamp jaws toward each other, so as to retain the article of clothing on the hanger. The locking device is usually resilient so that when removed from engagement with the clamp, the legs thereof are restored to their original unflexed condition.

In accordance with the prior art, the clamps are designed so as to be connected to the transverse support arm of the hanger by web means in a way which permits the entire plastic hanger assembly, including the jaws, to be molded in one piece. However, the locking members which are mounted so as to straddle the two clamping jaws and urge them into biasing engagement with each other to retain the garment in position on the hanger, are separate elements which, in the prior art, do not form part of the one piece molded plastic hanger. The prior art is best exemplified by U.S. Pat. No. 3,698,607.

In accordance with the prior art, the locking member is separate and unattached to the rest of the hanger, since the locking member would not be able to function in its intended manner unless it is free to move, and this was believed to be inconsistent with the one piece molded operation. As a result of the inability in the prior art to mold the locking device as part of a one piece plastic molded unit which is used to manufacture the hanger, these locking devices had to be manufactured separately from the hanger with which they are intended to be associated. This creates severe problems in that it becomes time consuming to establish and follow procedures in order to insure that the intended locking device is matched with the intended hanger. Furthermore, the locking device, being separate and distinct from the hanger proper, can easily be lost or separated from the associated hanger, causing severe inconvenience and great economic hardship. Furthermore, it is apparent that the locking device is an essential part of the hanger, as the absence of the locking device makes the hanger totally unusable, since the two clamping jaws would not be biased in confronting manner making it impossible to retain an article of clothing between the two clamping jaws. This is the most serious of all problems with the prior art procedure, as it renders a substantially complete hanger (missing only the locking device) totally useless to the customer. In fact, the mere misplacement of only one of two locking devices is sufficient to render an otherwise perfect hanger totally worthless.

SUMMARY OF THE INVENTION

It is therefore an object of this invention to provide a hanger of the type which supports articles of wearing apparel by a pair of clamps carried by the transverse supporting arm of the hanger. Each clamp comprises a stationery and a movable jaw biased toward each other into closed condition by means of a locking device which is molded as part of a one piece molded plastic hanger, thereby maintaining a physical connection with the locking device, so that the hanger always has the use of the locking device regardless of any other circumstance. The locking device is U-shaped and comprises a pair of legs mounted on a base and resiliently biased toward each other. The base is connected at its inner end to the transverse arm by means of a narrow web which defines an axis of rotation for the locking device. The use of a narrow web connecting the locking device to the transverse arm of the hanger enables the hanger to be molded in a one piece operation, which includes the locking device as connected to and integral with the hanger transverse arm by means of said narrow web.

It is another object of the invention to provide a locking device for the clamps on the transverse supporting rod, which locking device is connected by a narrow web to said transverse support member, so as to be substantially pivotable about an axis which is coaxial with said web, with said pivotable movement automatically placing the locking device in engagement with the confronting faces of the clamp jaws, such locking device being formed as part of a one piece molding of the hanger.

It is another object of the invention to provide a locking device having means easily graspable for moving said locking device into and out of locking engagement with the clamps on the transverse member of the hanger.

BRIEF DESCRIPTION OF THE DRAWINGS

FIG. 3 is a sectional view taken along lines 3—3 of FIG. 2.

FIG. 4 illustrates another embodiment of the invention, wherein the locking device is secured by a narrow web to the transverse supporting rod of the hanger at a point beyond the location of the clamp and is pivotable inwardly for locking engagement with the clamp.

DESCRIPTION OF THE PREFERRED EMBODIMENT

Figure 1:
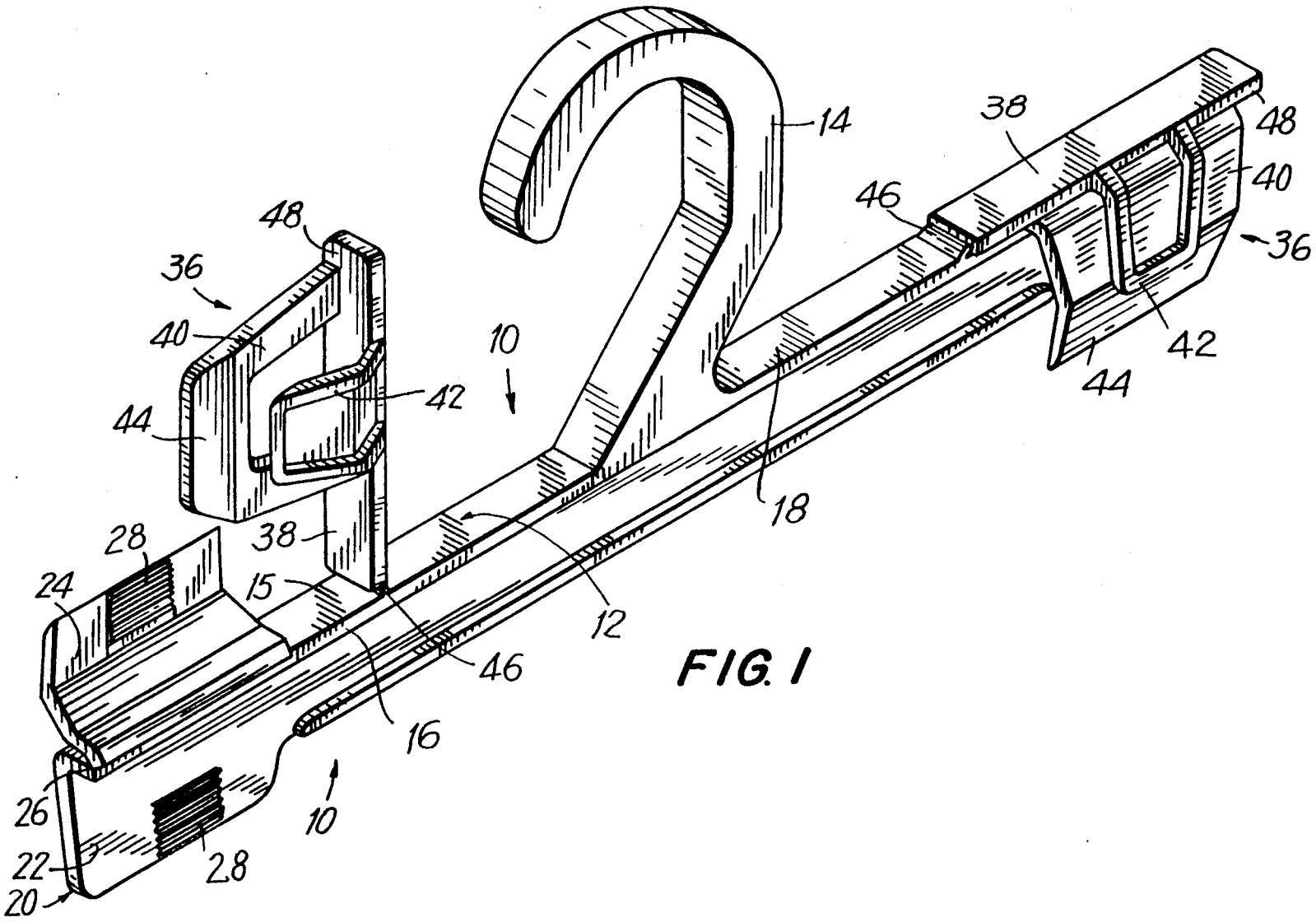
FIG. 1 is a perspective view of the hanger which illustrates the locking device and the manner in which it is mounted on the hanger proper for easy movement into and out of engagement with the clamp for locking the same.

Referring now to FIG. 1, there is shown a hanger 10, having a main body portion 12 and a hook 14 extending from said main body portion, said hook being for the purpose of suspending the hanger from a rack.

As best seen in FIG. 1, the main body portion consists of a transversely extending support member 15 at the mid-point of which is secured hook 14 dividing member 15 into arms 16 and 18, each provided at their respective ends with a clamp 20. Clamp 20 is defined by a stationery jaw 22 which is an integral part of arm 16 and a movable jaw 24 pivotably mounted to jaw 22 at its upper edge by means of a plastic web 26, so that jaw 24 is movable from an open position as shown on the left side of FIG. 1 to a closed position, as shown on the right side of FIG. 1 by pivoting said movable jaw 24 with respect t stationery jaw 22.

The inner or confronting surfaces of jaws 22 and 24 respectively, are provided with ribbing 28 for the purpose of enabling a garment to be frictionally held between the confronting jaws 22, 24 of the clamp 20. In accordance with the prior art, the confronting jaws of each clamp are maintained in biasing confronting relation by means of separate clip which straddles jaws 22 and 24 of member 20 and biases these jaws toward each other, so as to maintain the jaws in engagement with the garment tightly held inbetween.

While the above described construction has served industry well, it has not avoided a number of pitfalls. More specifically, since sizes of hangers vary and sizes of clamps vary, a particular clamp may necessitate a clip of particular dimension, configuration and resiliency, while another may not, so that the problem of matching or mismatching always exists. Secondly, the assembly of the hanger in its intended condition, i.e. with the garment held inbetween the jaws of the clamp, takes some additional time by virtue of the necessity to find the right clip and straddle the same onto the hanger.

In order to eliminate these obvious problems as well as others, there is provided in accordance with the present invention, a specially designed plastic locking device which is integral with the hanger proper as part of a one piece molded unit and movable into position wherein it biases the jaws of the clamp in the intended confronting relation in which the garment is held between the jaws. This is best shown in FIG. 1 wherein there is shown a locking device 36 comprising support bar 38, from which extends a pair of legs 40, 42, so as to define a saddle like member 44, which is adapted to straddle jaws 22, 24 of clamping member 20, much in the same manner as the prior art uses a clip to maintain the confronting jaws of the clamp biased towards each other, so as to frictionally grip an article held herebetween. The principal improvement brought about by this invention, is the provision of plastic locking means integral with the hanger proper as part of a one piece molded unit, to permanently have the locking device in position to be movable into and out of engagement with the clamp 20 without having any concern as to whether the locking device is the correct one to use, since the locking device is a permanent feature of the hanger. As best seen in FIG. 3, jaw 24 of the clamp 20 is made up of sections 24', 24" and 24"' which are angularly related to define a particular configuration which is complementary to leg 40 of the locking device in order to properly engage the locking device.

Figure 2:
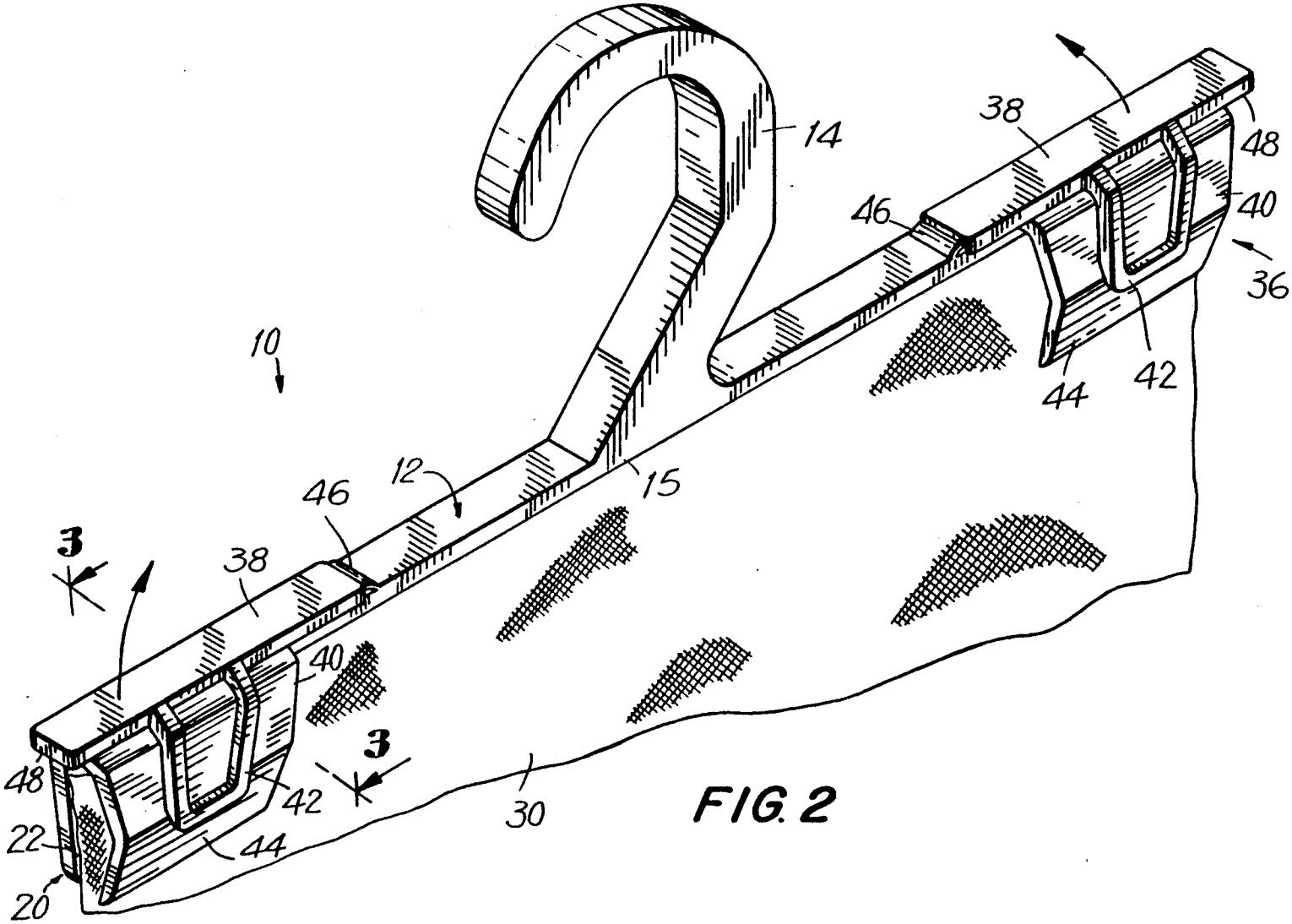
FIG. 2 is a view similar to FIG. 1, showing the locking device in its operative position in which it is secured to the hanger proper and in which it performs the function of locking the clamp jaws in confronting relation, so as to hold an item of clothing between the jaws.

As best shown in FIGS. 1 and 2, the locking device is integral with the hanger proper by means of webbing 46, which extends between support bar 38 and transverse member 12. The webbing is very short, so that for all intents and purposes the locking device is mounted for rotational movement about the axis of rotation defined by webbing 46.

It will be understood that the size, shape and location of webbing 46, jaws 22 and 24, legs 40, 42 of locking device are selected so that when the locking device is pivoted about webbing 46, legs 40 and 42 will automatically become juxtaposed over the clamp in an ideal fit to bias jaws 20, 22 toward each other with the clothing item therebetween, as shown in FIG. 1 and 3.

As best shown in FIG. 1, leg 40 of the locking device 36 is trapezoid in contour and has a center cutout adapted to receive narrow leg 40. It will also be evident that in molding the hanger, the dimensions of the locking device are such as to enable legs 40 and 42 to engage the outer surfaces of jaws 22, 24 with a biasing force holding the jaws in engagement on the clamp and, in turn, causing the legs of the clamp to frictionally hold a garment therebetween.

If desired, complementary ridge and groove 50 and 52, respectively, may be provided on the confronting surfaces of the clamp and locking leg 40 to enable such leg to snap into locked position when the locking member engages the clamp, and such will provide a positive locking feature for the hanger. In order to remove the locking member from its locked position, all one needs to do is to apply slight downward pressure to transverse bar 16, just enough to displace leg 40 sufficiently, so as to clear the ridge 50 on the jaw of the clamp.

With reference to FIG. 2, it will be noted that base 38 of the locking device projects beyond the end of the transverse supporting arms 16 and 18 to define, on each locking device, tab 52. Such tab is easily grasped with one's fingers for the purpose of moving the locking device in and out of engagement with its associated clamp. Alternatively, the projecting portion of the base, which defines tab 52, can be used for marking purposes, such as for marking the size, style number or other indicia pertinent to the garment carried by the hanger.

Thus, it is apparent that in accordance with the invention, a locking member is provided which is molded as a plastic one piece unit with the hanger and which is thus integral with the hanger. This construction eliminates all uncertainties and risks which are forever present in the prior art wherein the locking member used is a separate and separable member which must be independently selected by the assembler of the hanger. The above arrangement also eliminates the problem inherent in loss of the locking member used with a particular hanger.

Referring now to FIGS. 1-3 of the drawings, it will be noted that the locking device is connected to the transverse bar 12 in a manner whereby pivotal movement of the locking device is in the direction away from the center of the hanger when the locking device is to engage the jaws of the clamp and wherein said locking device pivotally moves toward the center of the hanger when the locking device is disengaged from the clamp.

It is with this construction that the overlapping tab 48 is provided.

Figure 5:
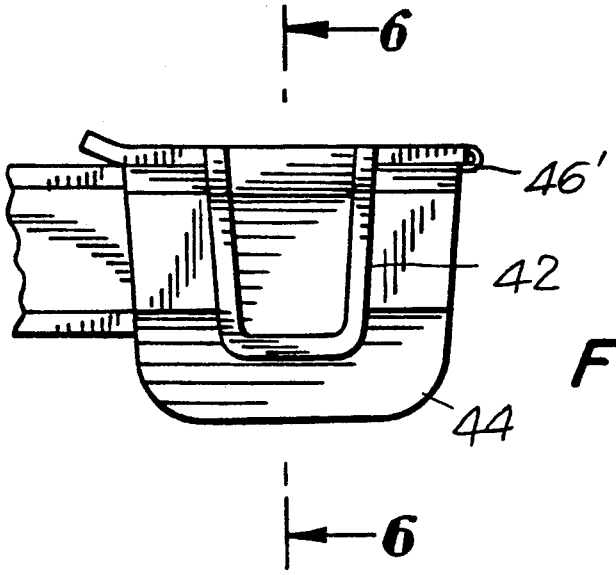
FIG. 5 is a fragmentary view showing the locking device of FIG. 4 is closed condition.
Figure 6:
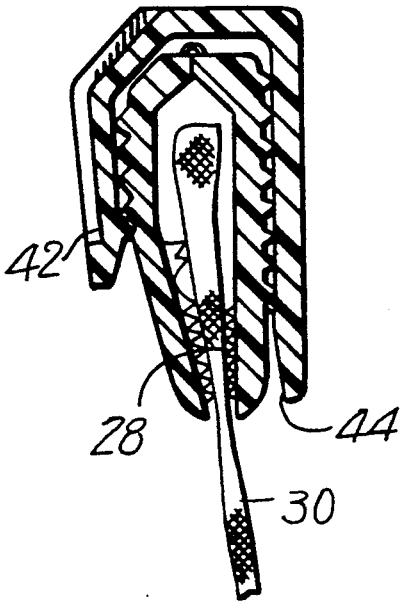
FIG. 6 is a sectional view taken along line 6—6 of FIG. 5.

The invention, however, is not limited to such orientation for the locking device. More specifically, and as shown in FIG. 4, the locking device 36' may be connected to the webbing 46' so that the locking device rotates towards the center of the hanger for engaging the clamp and away from said center in order to disengage from the clamp. This is shown in FIG. 4, from which it will be apparent that in such modification, the webbing 54 will be located further outwardly than the locking device and also that there will be an inwardly projecting tab 48' instead of an outwardly projecting tab as in FIGS. 1-3. In all other respects, the locking device is made in the same way as the one described in FIGS. 1-3, and functions in the same manner. FIG. 5 also illustrates, with greater clarity, the shapes of legs 40 and 42 as used in the devices as described herein. In such figure it will be noted that the contour of the wider leg 40 is indeed trapezoidal in contour, as is the central cutout in leg 40, which is therefore adapted to receive a smaller concentric trapezoid shape leg 42.

Obviously, numerous variations of the above described structure can occur to those of skill in the art. The invention is not to be limited to that described. The claims which follow, as the same are interpreted by the Courts, is the true scope of this invention.

I claim:

1. A clothes hanger comprising, a transversely extending support member having midway thereof means for suspending said hanger, at least one clamp carried by said support member, said clamp comprising a pair of jaws for holding therebetween the free end of an article of clothing; and locking means for maintaining said two clamping jaws biased against each other for retaining the article of clothing between said jaws; said locking means comprising a base having an inner end secured by means of a narrow webbing to said transversely extending support member at a location intermediate said hanger suspending means and said clamp, said base being pivotally movable about said webbing which functions as the axis of rotation for said base, said locking means comprising a pair of legs extending from opposite sides of said base and defining with said base a saddle shaped member pivotally movable above said webbing in unison with said base into a first position in engagement with said clamp to straddle the underlying jaws of the clamp so as to maintain said jaws in biased confronting relation and a second position released free of said clamp to release said jaws, said locking device being formed with said hanger from a one piece molding operation.

2. A clothes hanger comprising, a transversely extending support member having midway thereof means for suspending said hanger, at least one clamp carried by said support member, said clamp comprising a pair of jaws for holding therebetween the free end of an article of clothing; and locking means for maintaining said two clamping jaws biased against each other for retaining the article of clothing between said jaws; said locking means comprising a base having an inner end secured by means of a narrow webbing to said transversely extending support member at a location outwardly of said clamp, said base being pivotally movable about said webbing which functions as the axis of rotation for said base, said locking means comprising a pair of legs extending from opposite sides of said base and defining with said base a saddle shaped member pivotally movable about said webbing in unison with said base into a first position in engagement with said clamp to straddle the underlying jaws of the clamp so as to maintain said jaws in biased confronting relation and a second position released free of said clamp to release said jaws, said locking device being formed with said hanger from a one piece molding operation.

3. A clothes hanger in accordance with claim 1, wherein there is provided a second clamp and locking device therefor similar to the first mentioned clamp and locking device.

4. A clothes hanger in accordance with claim 1, wherein said at least one clamp is carried adjacent one end of said support member and wherein there is provided a second clamp which is carried adjacent the opposite end of said support member; said second clamp comprising a pair of jaws for holding therebetween the free end of said article of clothing; and locking means for maintaining the jaws of said second clamp biased against each other; said last mentioned locking means having the same construction as said first locking means and including a base and a pair of legs extending from opposite sides of said base to define a second saddle shaped member pivotally movable in unison with the base of said last mentioned locking means into and out of engagement with said second clamp to straddle the underlying jaws of the second clamp so as to maintain said jaws in biased confronting relation.

5. A clothes hanger in accordance with claim 1, wherein said base rotates about said axis of rotation in a direction away from the center of the transversely extending member to engage and straddle the jaws of the clamp.

6. A clothes hanger in accordance with claim 2, wherein said base rotates about said axis of rotation in a direction towards the center of the hanger to engage and straddle the jaws of the clamp.

7. A clothes hanger in accordance with claim 1, wherein the legs of the locking means are dissimilar in shape, one of said legs being larger than the other.

8. A clothes hanger comprising, a transversely extending support member having midway thereof means for suspending said hanger, at least one clamp carried by said support member, said clamp comprising a pair of jaws for holding therebetween the free end of an article of clothing; and locking means for maintaining said two clamping jaws biased against each other for retaining the article of clothing between said jaws; said locking means comprising a base having an inner end secured by means of a narrow webbing to said transversely extending support member at a location intermediate said hanger suspending means and said clamp, said base being pivotally movable about said webbing which functions as the axis of rotation for said base, said locking means comprising a pair of legs extending from opposite sides of said base and defining with said base a saddle shaped member pivotally movable about said webbing in unison with said base into a first position in engagement with said clamp to straddle the underlying jaws of the clamp so as to maintain said jaws in biased confronting relation and a second position released free of said clamp to release said jaws.

9. A clothes hanger comprising, a transversely extending support member having midway thereof means for suspending said hanger, at least one clamp carried by said support member, said clamp comprising a pair of jaws for holding therebetween the free end of an article of clothing; and locking means for maintaining said two clamping jaws biased against each other for retaining the article of clothing between said jaws; said locking means comprising a base having an inner end secured by means of a narrow webbing to said transversely extending support member at a location outwardly of said clamp, said base being pivotally movable about said webbing which functions as the axis of rotation for said base, said locking means comprising a pair of legs extending from opposite sides of said base and defining with said base a saddle shaped member pivotally movable about said webbing in unison with said base into a first position in engagement with said clamp to straddle the underlying jaws of the clamp so as to maintain said jaws in biased confronting relation and a second position released free of said clamp to release said jaws.

* * * * *

UNITED STATES PATENT AND TRADEMARK OFFICE

CERTIFICATE OF CORRECTION

PATENT NO. : 5,297,706

DATED : March 29, 1994

INVENTOR(S) : Leslie Blitz

It is certified that error appears in the above-indentified patent and that said Letters Patent is hereby corrected as shown below:

In Column 5, line 45: change "above" to -about-

Signed and Sealed this

Twenty-sixth Day of July, 1994

*Attest:*

*Attesting Officer*

BRUCE LEHMAN

*Commissioner of Patents and Trademarks*